US008459332B1

(12) United States Patent
O'Connor et al.

(10) Patent No.: US 8,459,332 B1
(45) Date of Patent: Jun. 11, 2013

(54) PISTON OUTER PANEL MOLD AND METHOD OF CONSTRUCTING A PISTON AND FORMING AN UNDERCUT COOLING GALLERY OF A PISTON THEREWITH

(76) Inventors: Kevin M. O'Connor, South Bend, IN (US); Timothy D. Frank, Elkhart, IN (US); Andrew J. Miller, Plymouth, MI (US)

( * ) Notice: Subject to any disclaimer, the term of this patent is extended or adjusted under 35 U.S.C. 154(b) by 0 days.

(21) Appl. No.: 13/544,978

(22) Filed: Jul. 9, 2012

(51) Int. Cl.
*B22D 33/04* (2006.01)
*B22D 17/00* (2006.01)

(52) U.S. Cl.
USPC ..... 164/113; 164/137; 164/312; 164/342

(58) Field of Classification Search
USPC ..... 164/113, 119, 137, 342, 306–318
See application file for complete search history.

(56) References Cited

U.S. PATENT DOCUMENTS

| | | | | |
|---|---|---|---|---|
| 2,286,994 | A | 6/1942 | Nocar | |
| 2,287,524 | A | 6/1942 | Jackson | |
| 2,676,372 | A | 4/1954 | Venner et al. | |
| 2,711,568 | A | 6/1955 | Palmer et al. | |
| 2,789,329 | A | 4/1957 | Peterson et al. | |
| 2,948,031 | A | 8/1960 | Webb | |
| 4,206,799 | A | 6/1980 | McDonald | |
| 4,502,660 | A | 3/1985 | Luther et al. | |
| 4,695,421 | A * | 9/1987 | Takeda | 264/318 |
| 5,074,352 | A | 12/1991 | Suzuki | |
| 5,295,379 | A | 3/1994 | Trbovich et al. | |
| 5,295,804 | A | 3/1994 | Dinnan | |
| 6,546,993 | B1 | 4/2003 | Tilch | |
| 7,213,562 | B2 | 5/2007 | Schnaitmann | |
| 7,891,403 | B2 * | 2/2011 | Frank et al. | 164/137 |

FOREIGN PATENT DOCUMENTS

| | | | |
|---|---|---|---|
| JP | 61074817 | A | 4/1986 |
| JP | 2001-150097 | | 6/2001 |
| KR | 820001905 | B1 | 10/1982 |

* cited by examiner

*Primary Examiner* — Kevin P Kerns
(74) *Attorney, Agent, or Firm* — Robert L. Stearns; Dickinson Wright, PLLC

(57) ABSTRACT

An outer panel mold and method of constructing a piston and forming an undercut cooling gallery of a piston therewith is provided. The outer panel mold is operably attachable to a conventional piston mold machine. The outer panel mold has a pair of gudgeon core members and a pair of gudgeon guide blocks. The gudgeon core members are moveable toward and away from one another along an axis that is substantially perpendicular to a longitudinal central axis of a piston. Each of the gudgeon guide blocks have an opening receiving a separate one of the gudgeon core members. A pair of outer panels are moveable into a closed position between the pair of gudgeon guide blocks to form an undercut cooling gallery of the piston and an open position to allow extraction of the piston vertically along the longitudinal central axis in response to movement of the gudgeon guide blocks.

26 Claims, 7 Drawing Sheets

PISTON OUTER PANEL MOLD AND METHOD OF CONSTRUCTING A PISTON AND FORMING AN UNDERCUT COOLING GALLERY OF A PISTON THEREWITH

BACKGROUND OF THE INVENTION

1. Field of the Invention

This invention relates generally to pistons and methods of construction thereof, and more particularly to piston molds and methods of construction therewith.

2. Related Art

It is known to construct a piston with an annular cooling gallery having an undercut located immediately radially inward of a piston ring belt. The undercut provides an overhanging portion of ring belt, which in turn presents complications in casting the piston. To avoid having to machine the undercut after casting, the mold cavity must include a projection or panel having a negative shape of the desired undercut configuration. However, in order to extract or remove the cast piston from the mold cavity, the panel must be removed completely from the undercut and the mold cavity. Because the depending ring belt is formed radially outward from the undercut, the panel cannot be simply moved radially outwardly in a purely horizontal direction from the undercut. To further complicate matters, pin bosses formed in the molding process that depend from the ring belt in laterally spaced relation from one another and flare laterally outwardly with respect to a central axis of the piston prevent the undercut forming panel from being moved downwardly in a purely vertical direction. Accordingly, to overcome this problem, many known mold assemblies include a panel that must be pivoted out of the mold cavity. However, the pivoting motion of the panel restricts the size of the available undercut that can be formed depending on the envelop dimensions of the mold cavity.

SUMMARY OF THE INVENTION

A piston outer panel mold that is operably attachable to a conventional piston mold machine is provided. The outer panel mold has a pair of gudgeon core members and a pair of gudgeon guide blocks. The gudgeon core members are moveable toward and away from one another along a linear path that is substantially perpendicular to a longitudinal central axis of a piston between an engaged position and a disengaged position. Each of the gudgeon guide blocks having an opening receiving a separate one of the gudgeon core members for slideable movement therein. The outer panel mold further includes a pair of outer panels moveable into a closed position between the pair of gudgeon guide blocks to form an undercut cooling gallery of the piston. The outer panels are movable to an open position to allow extraction of the piston vertically along the longitudinal central axis. The outer panels are moveable in response to movement of the gudgeon guide blocks.

In accordance with another aspect of providing the piston outer panel mold, the outer panels can be configured as being moveable toward each other along a converging linear path toward the closed position and configured as being moveable away from each other along a diverging linear path to the open position.

According to another aspect of the invention a method of foiming an undercut cooling gallery of a piston is provided. The method includes moving a pair of gudgeon core members toward one another to an engaged position through respective gudgeon guide blocks along a common gudgeon pin axis. Further, driving the gudgeon guide blocks toward one another along the gudgeon pin axis while moving the gudgeon core members toward their engaged position. Further yet, driving a pair of outer panels into a closed position in response to movement of the gudgeon core blocks. Then, molding fluid piston material about upper portions of the outer panels to form the undercut cooling gallery. Then, moving the gudgeon core members away from one another to a disengaged position along the gudgeon pin axis. Further yet, driving the gudgeon guide blocks away from one another along the gudgeon pin axis in response to movement of the gudgeon core members toward their disengaged position. Further, driving the outer panels into an open position in response to movement of the gudgeon core blocks.

In accordance with another aspect of the invention, the method of forming an undercut cooling gallery of a piston can further include moving the outer panels toward the closed position along a converging linear path that is oblique to the gudgeon pin axis and toward the open position away from one another other along a diverging linear path that is oblique to the gudgeon pin axis.

In accordance with another aspect of the invention, a method of constructing a piston is provided. The method includes providing a conventional mold machine and attaching an outer panel mold to the mold machine. The outer panel mold includes a pair of gudgeon core members, a pair of gudgeon guide blocks, and a pair of outer panels. The method further includes moving the pair of gudgeon core members toward one another through respective gudgeon guide blocks along a common gudgeon pin axis to an engaged position. Further yet, the method includes driving the gudgeon guide blocks toward one another along the gudgeon pin axis while the gudgeon core members are moving toward their engaged position. Further yet, the method includes driving the pair of outer panels into a closed position in response to movement of the gudgeon core blocks. Then, molding fluid piston material within a mold cavity to form a piston body and about upper portions of the outer panels to form the undercut cooling gallery within the piston body. The method then includes moving the gudgeon core members away from one another to a disengaged position along the gudgeon pin axis. Further yet, driving the gudgeon guide blocks away from one another along the gudgeon pin axis in response to movement of the gudgeon core members toward their disengaged position. Further, driving the outer panels into an open position in response to movement of the gudgeon core blocks. Then, removing the piston body from the mold cavity.

In accordance with another aspect of the method of constructing a piston, the method can further include moving the outer panels toward the closed position along a converging linear path that is oblique to the gudgeon pin axis and moving the outer panels toward the open position along a diverging linear path that is oblique to the gudgeon pin axis.

BRIEF DESCRIPTION OF THE DRAWINGS

These and other aspects, features and advantages of the invention will be readily appreciated when considered in connection with the following detailed description of the presently preferred embodiments and best mode, appended claims and accompanying drawings, wherein:

DETAILED DESCRIPTION OF PRESENTLY PREFERRED EMBODIMENTS

Figure 1:
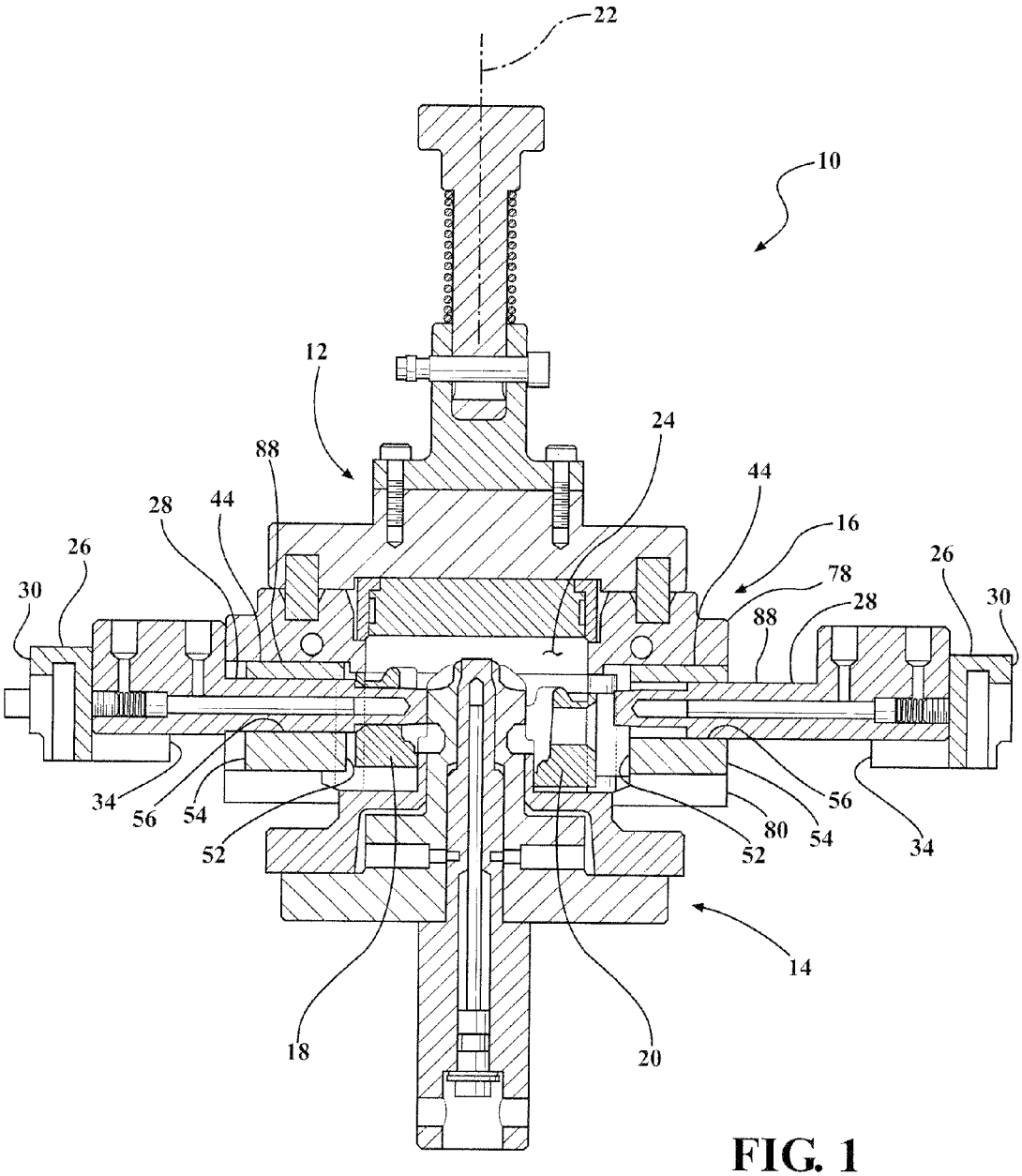
FIG. 1 is a cross-sectional view of a mold machine having an outer panel mold in accordance with one presently preferred embodiment of the invention.

Referring in more detail to the drawings, FIG. 1 illustrate a mold machine 10, such as a convention or standard mold machine, having a top core 12, also referred to head core, configured to form an upper crown portion of a piston; a main core 14 configured to form inner surfaces of the piston, and an outer panel mold 16 having a pair of diametrically opposite outer panels 18, 20 constructed in accordance with one aspect of the invention. The outer panel mold 16 provides the ability to readily convert the conventional mold machine 10 into a mold machine that is capable of molding complex undercut cooling galleries extending into an under surface of a piston head, thereby providing a quick and economical way in which to form pistons having complex-shaped outer cooling galleries, as desired. The undercut cooling galleries can be formed having any number of complex forms and shapes that are otherwise unattainable with a standard piston mold machine. For example, the undercut cooling galleries, due to the mechanism discussed hereafter with regard to the outer panels 18, 20, can extend radially upwardly and radially inwardly into outer faces of pin bosses of the piston, thereby forming diametrically opposite outer cooling galleries that converge toward one another, without concern of having to incorporate complex pivoting mechanisms, such as those discussed in the Related Art section above, or by having to use a complex dedicated piston mold machine specifically designed to make a single piston configuration. Accordingly, the outer panel mold 16 provides a quick and economical apparatus and method by which a conventional piston mold machine can be readily converted to mold pistons having complex outer cooling galleries extending, at least in part, into opposite outer faces of diametrically opposite pin bosses that diverge or flare outwardly toward free ends of the pin bosses, while at the same time allowing the conventional mold machine to be readily adapted to mold conventional pistons without undue expense.

The top core 12 and main core 14 can be provided as standard components of the standard mold machine 10 to mold an upper crown and internal features of the piston, as desired. The top core 12 and main core 14 move vertically along a central longitudinal axis 22, corresponding to a central axis of the molded piston, between disengaged and engaged positions, as is known. When moved to their respective disengaged positions, the molded piston can be removed along a purely vertically upward direction from a mold cavity 24 without concern of interference with the mold components. This is due in large part to the ability to move the panels 18, 20 of the outer panel mold 16 outwardly from their respective cooling galleries, either along an axis extending in oblique relation to the central longitudinal axis 22, or along an axis that is parallel or substantially parallel to the central longitudinal axis 22, depending on the configuration of the outer panel mold 16, discussed hereafter.

Figure 2:
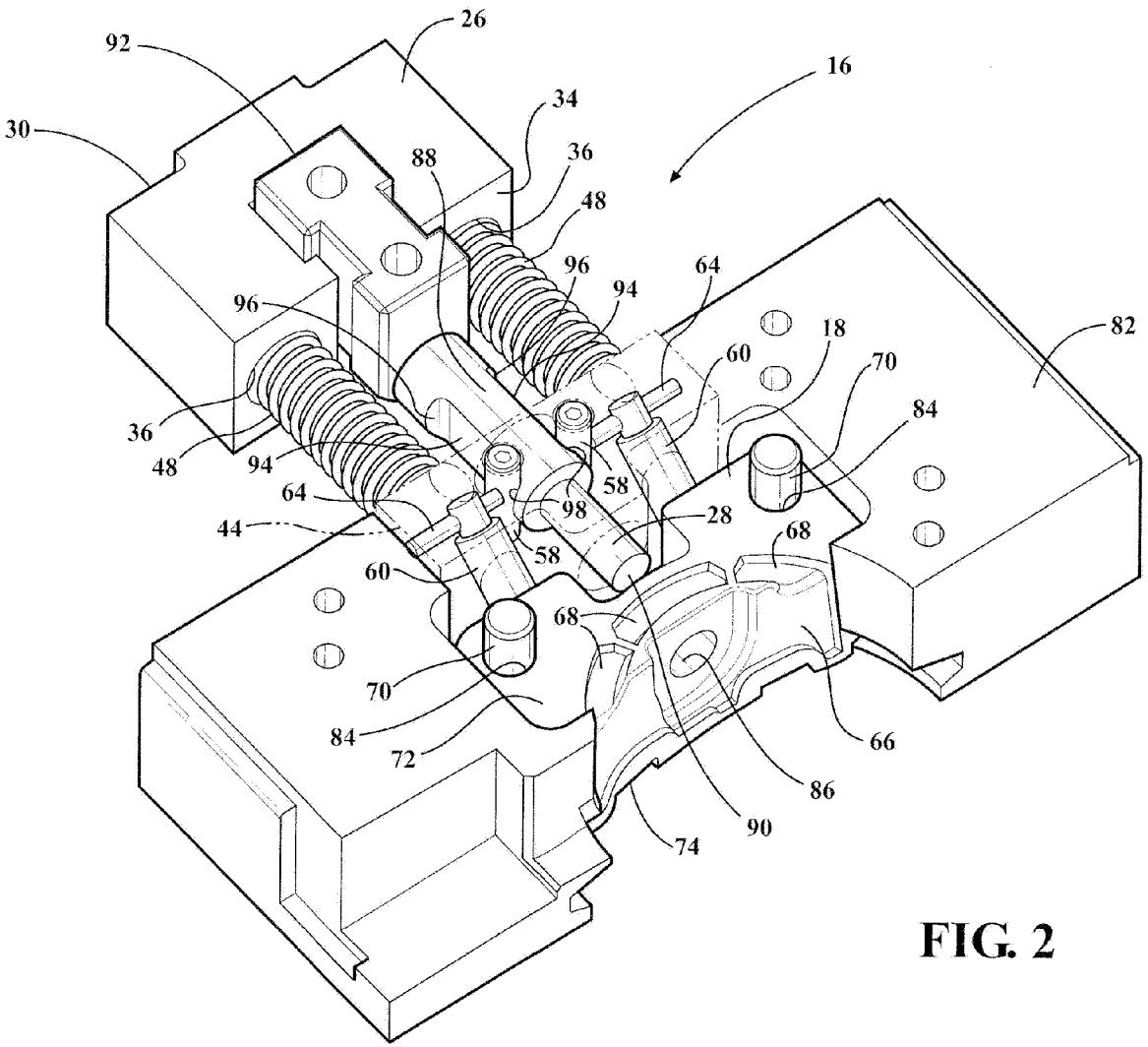
FIG. 2 is a perspective view of the outer panel mold of FIG. 1 shown in an open position.
Figure 3:
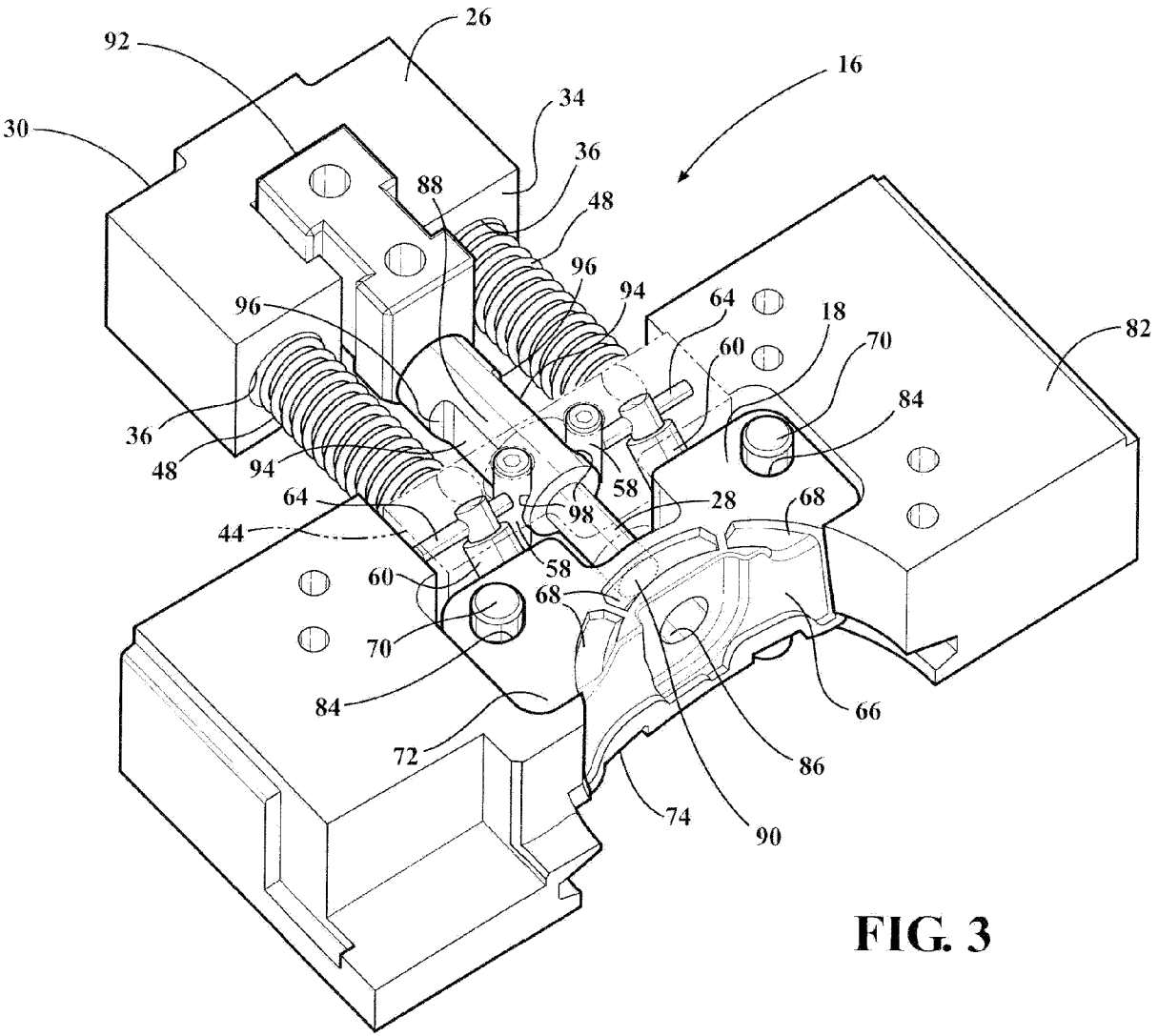
FIG. 3 is a view similar to FIG. 2 showing the outer panel mold in an intermediate position.
Figure 4:
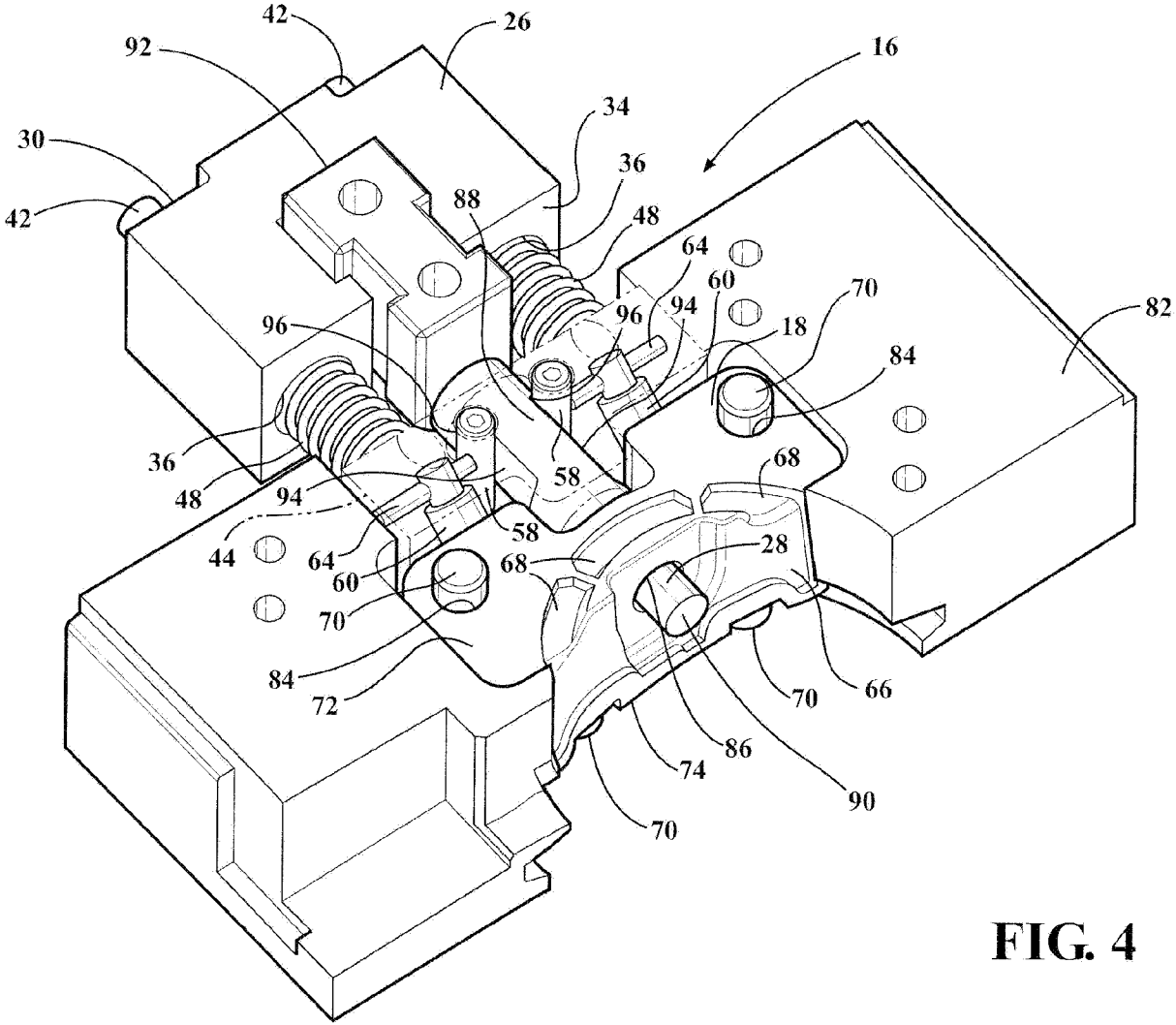
FIG. 4 is a view similar to FIG. 2 showing the outer panel mold in a closed position.
Figure 5:
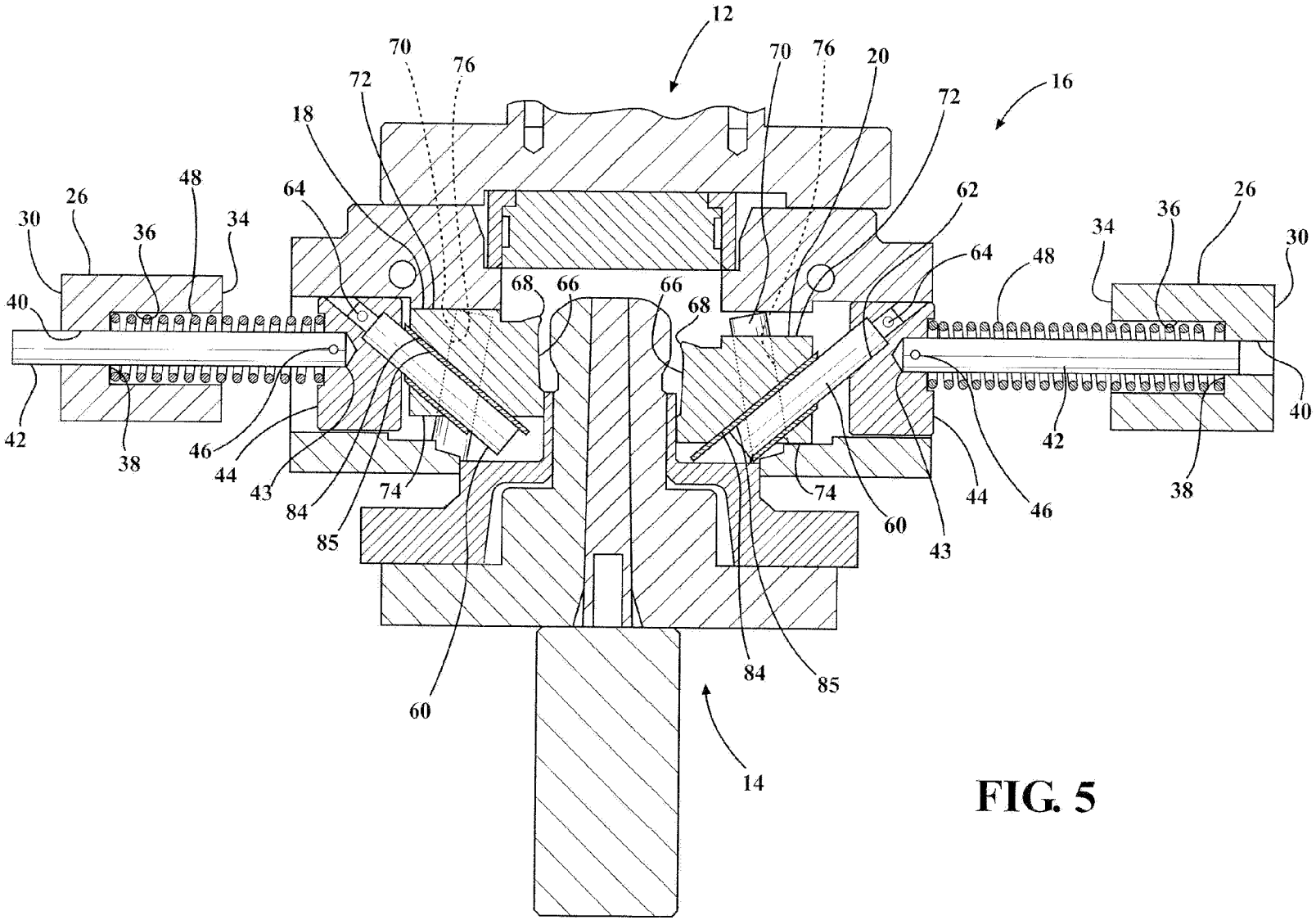
FIG. 5 is a split cross-sectional view taken through drive members of the outer panel mold showing the outer panel mold in a closed position on the left and in an open position on the right.

As best shown in FIGS. 2-4, the outer panel mold 16 includes a pair of gudgeon pin core drive blocks 26, referred to hereafter as pin core drive blocks and a pair of corresponding gudgeon pin cores 28, also referred to as pin bore mandrels or pin bore cores. Each pin core drive block 26 has one side 30 configured for operable attachment to a linear actuator (not shown) and an opposite side 32 configured for operable attachment to an end 34 of the pin bore core 28, shown as being connected via an dovetail-type joint connection, by way of example and without limitation. The pin core drive blocks 26 further include a pair of recessed bores or pockets 36 extending to a bottom surface or base 38 (FIG. 5). The bases 38 have reduced diameter through openings 40 extending therethrough for sliding receipt of a corresponding guide rod 42, wherein one end 43 of each guide rod 42 is operably fixed to a pin core guide block, also referred to as guide block 44, such as via pins 46 (FIG. 5), for example. The pockets 36 are configured for partial receipt of corresponding spring members 48 that abut the bottom surface 38 and extend outwardly from the pockets 36 into at least slightly compressed abutment with the guide block 44.

The guide blocks 44 have opposite sides 52, 54 with a centrally located through bore 56 extending therethrough. The through bores 56 are sized for close sliding receipt of the pin bore cores 28 therethrough. Accordingly, upon movement of the pin core drive blocks 26, the pin bore cores 28 are free to slide through the through bores 56 between engaged and disengaged positions (FIGS. 2 and 4, respectively).

The guide blocks 44 have a pair of driven members 58 and a pair of drive members 60. The driven members 58 are fixed to the guide blocks 44 and are selectively driven in response to axial movement of the pin bore cores 28 to cause conjoint movement of the outer panels 18, 20. The driven members 58 are shown as vertically extending pins that are fastened in fixed relation to the guide blocks 44, by way of example and without limitation. The drive members 60 are received in corresponding passages 62 in the guide blocks 44 that are sized for a close fit of the drive members 60 therein. The drive members 60 are fixed in the passages 62, such as via pins 64, by way of example and without limitation. The passages 62, and thus the drive members 60, extend at an angle oblique to the central longitudinal axis 22, shown as extending between about 30-60 degrees relative to the axis 22, though the angle can be provided outside of this range, as desired. The angle of inclination is oriented such that the drive members 60 extend upwardly and radially outwardly, such that they diverge from one another from lower ends toward upper ends.

Figure 6:
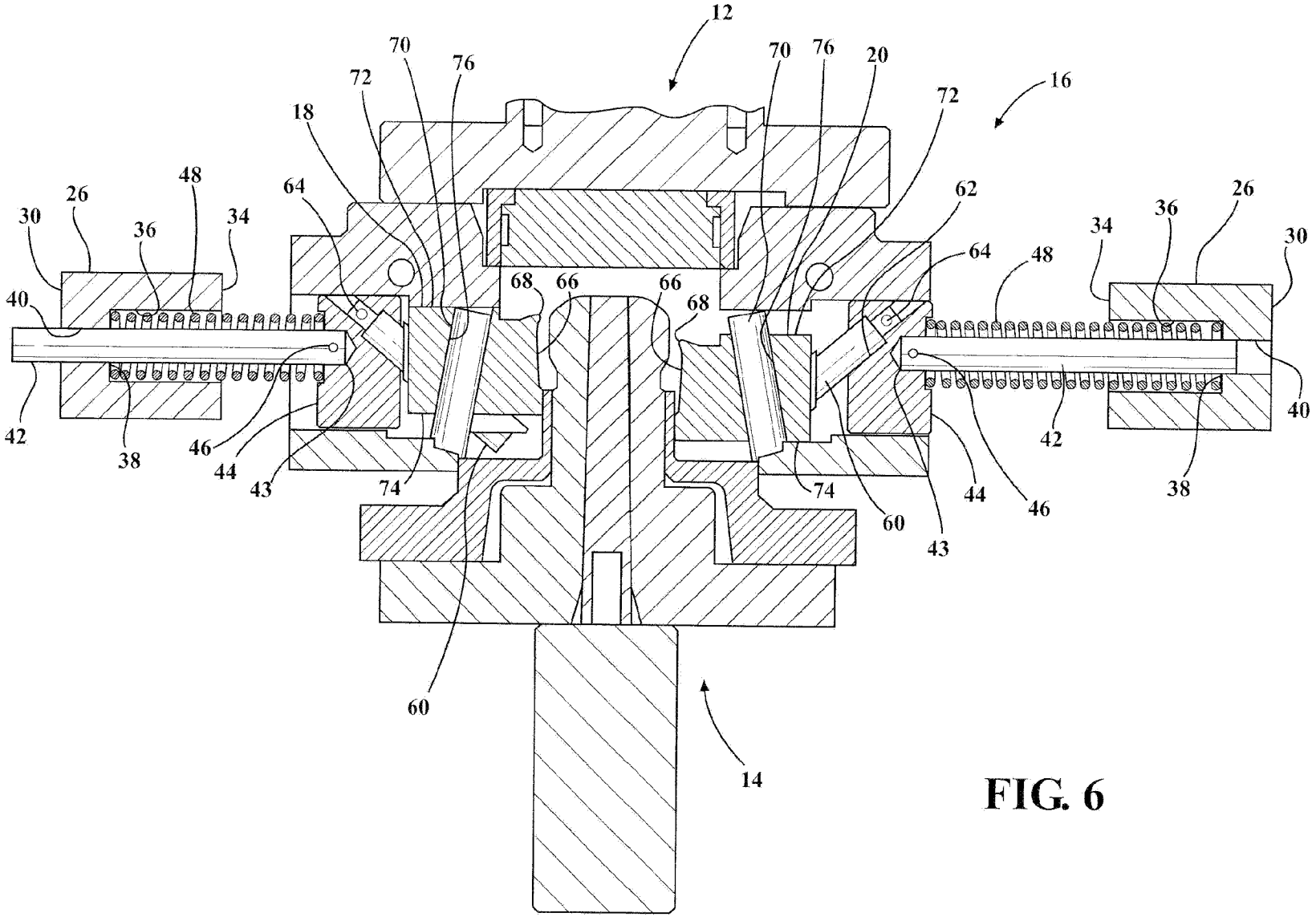
FIG. 6 is a split cross-sectional view taken through guide members of the outer panel mold showing the outer panel mold in a closed position on the left and in an open position on the right.
Figure 6A:
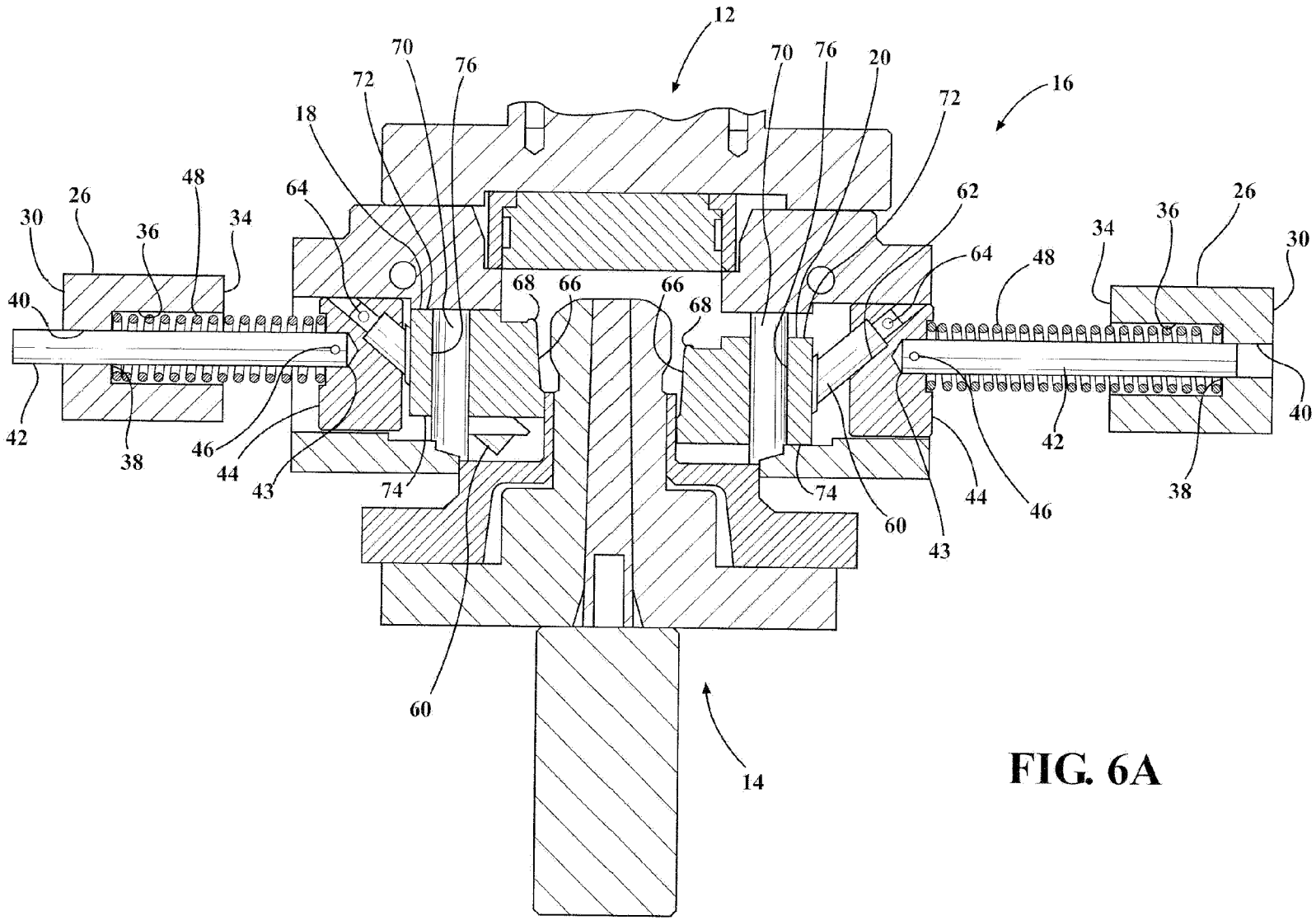
FIG. 6A is a view similar to FIG. 6 of an outer panel mold constructed in accordance with another aspect of the invention.

The outer panels 18, 20 having inner surfaces 66 contoured to form the desired shape of the pin boss outer faces. Further, the outer panels have upperwardly extending protrusions 68 shaped as negatives of the desired shape of the outer cooling galleries formed thereby. The protrusions 68 can extend axially upwardly and radially inwardly, such that the outer cooling galleries formed thereby extend axially upwardly and radially inwardly relative to the outer face of the pin boss depending immediately therefrom. Ordinarily, a cooling gallery shaped in this configuration would require an elaborate pivoting mechanism or dedicated mold machine in order to remove the negative mold protrusion therefrom, however, the outer panels 18, 20, in accordance with one aspect of the invention, are able to be guided along a straight linear path via a pair of outer panel guide members 70, also referred to as guide pins. The guide pins 70 can be oriented to extend along any desired angle of inclination, such that the guide pins 70 can extend in oblique relation to the central longitudinal axis 22 (FIG. 6), such as extending axially upwardly and radially inwardly generally toward the central longitudinal axis 22, or in parallel or substantially parallel relation with the central longitudinal axis 22 (FIG. 6A). The guide pins 70 extend through upper and lower faces 72, 74 via through passages 76 in a close sliding fit therein. Accordingly, the through passages 76 act as bushings through which the guide members 70 slide in response to the outer panels 18, 20 being driven by the drive members 60 of the pin core guide block 44. The guide pins 70 are captured at opposite ends by upper and lower plates 78, 80, while an intermediate plate 82 bounds or substantially bounds the outer panel mold 16.

The outer panels 18, 20 further include through passages 84 sized for close sliding receipt of the drive members 60 therethrough, shown has being lined with bushings 85, by way of example. The through passages 84, and thus the drive members 60, extend in oblique relation to the central longitudinal axis 22, shown as extending axially upwardly and radially outwardly from the axis 22. Further, the outer panels 18, 20 each include through openings 86 sized for close sliding receipt of the pin bore cores 28 as they move between their engaged and disengaged positions. When the pin bore cores 28 are in their fully engaged position, free ends of the pin bore cores 28 extend beyond the inner surfaces 66 to form gudgeon pin bores in the pin bosses during molding.

The pin bore cores 28 have a central portion 88 extending between opposite ends 90, 92. The central portion 88 includes a recessed notch, shown as a pair of diametrically opposite recessed notches 94 extending axially between opposite shoulders 96, 98. The recessed notches 94 are contoured to receive the driven members 58 therein. The shoulders 96, 98 extend outwardly from the recessed notches 94 to abut the driven members 58 while closing and opening the outer panel mold 16, as discussed further below.

In operation, with the mold machine 10 in and open and disengaged position, the actuator (not shown) is actuated to push radially inwardly on the pin core drive blocks 26, which in turn causes conjoint radially inward movement of the pin bore cores 28. As the pin bore cores 28 advance coaxially toward one another, the spring members 48, having a sufficient spring force, cause the guide blocks 44 to move axially toward the outer panels 18, 20, which in turns causes the drive members 58, 60 to slide through the corresponding through passages 84, which in turn cause the outer panels 18, 20 to be driven vertically upwardly and radially inwardly along the guide members 70. Upon the outer panels 18, 20 moving into their closed position and the pin core guide blocks 44 abutting the outer panels 18, 20, the axial travel of the pin bore cores 28 continues as the driven members 58 traverse the recessed notches 94. Then, upon the driven members 58 engaging the shoulders 96, the outer panels 18, 20 are locked into their closed positions.

The top core 12 and main core 14 are moved into their respective closed positions, and then a suitable liquid piston mold material is introduced into the mold cavity 24. The mold material is allow to cool sufficiently, and then the mold is opened to allow the piston to be remove vertically upwardly from the mold cavity 24.

To initiate opening the mold cavity 24, the sequence of closing the mold components is essentially reversed. Accordingly, the actuator (not shown) is retracted to pull radially outwardly on the pin core drive blocks 26, which in turn causes conjoint radially outward movement of the pin bore cores 28. As the pin bore cores 28 retract coaxially away from one another, the spring members 48, having a sufficient spring force, maintain the guide blocks 44 in abutment with the outer panels 18, 20, and the recessed notches 94 move along the driven members 58 until the shoulders 98 engage the driven members 58. Upon the shoulders 98 engaging the driven members 58, the shoulders 98 pull the driven members 58 axially outwardly, which in turn causes the ping core guide blocks 44 to move conjointly with the pin bore cores 28. The movement of the guide blocks 44 causes conjoint movement of the drive members 58, 60 which slide through the corresponding through passages 84, which in turn cause the outer panels 18, 20 to be driven vertically downwardly and radially outwardly along the guide members 70. Upon the outer panels 18, 20 moving into their open position, and the top core 12 and main core 14 being moved vertically to their corresponding retracted positions, the piston is free to be lifted vertically outwardly from the open mold cavity 24.

In accordance with yet another aspect of the invention, a method of forming an undercut cooling gallery in a piston is provided. The method includes moving a pair of gudgeon core members 28 toward one another to an engaged position through respective gudgeon guide blocks 44 along a common gudgeon pin axis. Further, driving the gudgeon guide blocks 44 toward one another along the gudgeon pin axis while moving the gudgeon core members 28 toward their engaged position. Further yet, driving a pair of outer panels 18, 20 into a closed position in response to movement of the gudgeon guide blocks 44. Then, molding fluid piston material about upper portions 68 of the outer panels 18, 20 to form the undercut cooling gallery. Then, moving the gudgeon core members 28 away from one another to a disengaged position along the gudgeon pin axis. Further, driving the gudgeon guide blocks 44 away from one another along the gudgeon pin axis in response to movement of the gudgeon core members 28 toward their disengaged position. Then, driving the outer panels 18, 20 into an open position in response to movement of the gudgeon guide blocks 44.

Additional aspect of the method of forming the undercut can include the following: sliding the outer panels 18, 20 along members 60, 70 in response to movement of the gudgeon guide blocks 44; orienting the members 60, 70 to extend in oblique relation to the gudgeon pin axis; moving the gudgeon core members 28 relative to the gudgeon guide blocks 44 during at least a portion of the movement of the gudgeon core members 28 between their engaged and disengaged positions; moving the gudgeon guide blocks 44 conjointly with the gudgeon core members 28 during at least a portion of the movement of the gudgeon core members 28 between their engaged and disengaged positions; moving the outer panels 18, 20 toward the closed position along a converging linear path that is oblique to the gudgeon pin axis; and moving the outer panels 18, 20 toward the open position away from one another other along a diverging linear path that is oblique to the gudgeon pin axis.

In accordance with yet another aspect of the invention, a method of constructing a piston is provided. The method includes providing a conventional mold machine and attaching an outer panel mold 16 to the mold machine. The outer panel mold 16 includes a pair of gudgeon core members 28, a pair of gudgeon guide blocks 44, and a pair of outer panels 18, 20. Further, moving the pair of gudgeon core members 28 toward one another through respective gudgeon guide blocks 44 along a common gudgeon pin axis to an engaged position. Then, driving the gudgeon guide blocks 44 toward one another along the gudgeon pin axis while the gudgeon core members 28 are moving toward their engaged position. Further, driving the pair of outer panels 18, 20 into a closed position in response to movement of the gudgeon guide blocks 44. Then, molding fluid piston material within a mold cavity 24 to form a piston body and about upper portions 68 of the outer panels 18, 20 to form the undercut cooling gallery within the piston body. Further yet, moving the gudgeon core members 28 away from one another to a disengaged position along the gudgeon pin axis. Then, driving the gudgeon guide blocks 44 away from one another along the gudgeon pin axis in response to movement of the gudgeon core members 28 toward their disengaged position. Further, driving the outer panels 18, 20 into an open position in response to movement of the gudgeon guide blocks 44. Then, removing the piston body from the mold cavity 24.

Additional aspect of the method of constructing a piston can include the following: sliding the outer panels 18, 20 along members 60, 70 in response to movement of the gudgeon guide blocks 44; orienting the members 60, 70 to extend in oblique relation to the gudgeon pin axis; moving the gudgeon core members 28 relative to the gudgeon guide blocks 44 during at least a portion of the movement of the gudgeon core members 28 between their engaged and disengaged positions; moving the gudgeon guide blocks 44 conjointly with the gudgeon core members 28 during at least a portion of the movement of the gudgeon core members 28 between their engaged and disengaged positions; and moving the outer panels 18, 20 toward the closed position along a converging linear path that is oblique to the gudgeon pin axis; moving the outer panels 18, 20 toward the open position along a diverging linear path that is oblique to the gudgeon pin axis.

It is to be understood that the above detailed description is with regard to some presently preferred embodiments, and that other embodiments which accomplish the same function are incorporated herein within the scope of any ultimately allowed patent claims.

What is claimed is:

1. A piston outer panel mold that is operably attachable to a conventional piston mold machine, said outer panel piston mold comprising:

a pair of gudgeon core members;

a pair of gudgeon guide blocks moveable toward and away from one another along a linear path that is substantially perpendicular to a central longitudinal axis of a piston between an engaged position and a disengaged position, each of said gudgeon guide blocks having an opening receiving a separate one of said gudgeon core members for slideable movement therein; and a pair of outer panels each operably connected to respective said gudgeon guide block and moveable vertically into a closed position between said pair of gudgeon guide blocks to form an undercut cooling gallery of the piston, said outer panels being movable vertically to an open position to allow extraction of the piston vertically along said central longitudinal axis, said outer panels being moveable between said open and closed positions in response to movement of said gudgeon guide blocks.

2. The piston outer panel mold of claim 1 further including at least one drive member fixed to each of said gudgeon guide blocks, said outer panels having an opening receiving said at least one drive member for slideable movement therein.

3. The piston outer panel mold of claim 2 wherein each of said outer panels move along said at least one drive member between their open and closed positions in response to movement of said at least one drive member.

4. The piston outer panel mold of claim 3 wherein said at least one drive member extends in oblique relation to said central longitudinal axis.

5. The piston outer panel mold of claim 3 wherein said gudgeon guide blocks move from their engaged position to their disengaged position in response to movement of said gudgeon core members.

6. The piston outer panel mold of claim 5 wherein each of said gudgeon guide blocks have at least one driven member, said gudgeon core members having a recessed notch extending between opposite shoulders.

7. The piston outer panel mold of claim 6 wherein said gudgeon core members are moveable relative to said gudgeon guide blocks when said driven member is spaced from said shoulders.

8. The piston outer panel mold of claim 6 wherein said gudgeon guide blocks move conjointly with said gudgeon core members when said driven member abuts one of said shoulders.

9. The piston outer panel mold of claim 1 wherein said pair of outer panels are moveable toward each other along a converging linear path toward said closed position and away from each other along a diverging linear path to said open position.

10. The piston outer panel mold of claim 2 wherein said pair of outer panels have upper and lower faces with at least one through opening extending therethrough, said at least one through opening receiving a guide member in a loose fit therein, and said outer panels sliding along said guide member in response to movement of said at least one drive member.

11. The piston outer panel mold of claim 10 wherein said guide member extends in oblique relation to said central longitudinal axis.

12. The piston outer panel mold of claim 11 wherein said guide member is inclined to extend axially upwardly in radially inwardly generally toward said central longitudinal axis.

13. A method of forming an undercut cooling gallery in a piston, comprising:

moving a pair of gudgeon core members toward one another to an engaged position through respective gudgeon guide blocks along a common gudgeon pin axis which is substantially perpendicular to a central longitudinal axis of the piston;

driving the gudgeon guide blocks toward one another along the gudgeon pin axis while moving the gudgeon core members toward their engaged position;

driving a pair of outer panels and moving the outer panels in a vertical direction into a closed position in response to movement of the gudgeon guide blocks the outer panels is operably connected to respect said gudgeon guide block;

molding fluid piston material about upper portions of the outer panels to form the undercut cooling gallery;

moving the gudgeon core members away from one another to a disengaged position along the gudgeon pin axis;

driving the gudgeon guide blocks away from one another along the gudgeon pin axis in response to movement of the gudgeon core members toward their disengaged position; and driving the outer panels into an open position in response to movement of the gudgeon guide blocks.

14. The method of claim 13 further including sliding the outer panels along members fixed to in response to movement of the gudgeon guide blocks.

15. The method of claim 14 further including orienting the members to extend in oblique relation to the gudgeon pin axis.

16. The method of claim 13 further including moving the gudgeon core members relative to the gudgeon guide blocks during at least a portion of the movement of the gudgeon core members between their engaged and disengaged positions.

17. The method of claim 16 further including moving the gudgeon guide blocks conjointly with the gudgeon core members during at least a portion of the movement of the gudgeon core members between their engaged and disengaged positions.

18. The method of claim 13 further including moving the outer panels toward the closed position along a converging linear path that is oblique to the gudgeon pin axis.

19. The method of claim 18 farther including moving the outer panels toward the open position away from one another other along a diverging linear path that is oblique to the gudgeon pin axis.

20. A method of constructing a piston, comprising:

providing a conventional mold machine;

attaching an outer panel mold to the mold machine, the outer panel mold having a pair of gudgeon core members, a pair of gudgeon guide blocks, and a pair of outer panels;

moving the pair of gudgeon core members toward one another through respective gudgeon guide blocks along a common gudgeon pin axis to an engaged position, wherein the gudgeon pin axis is substantially perpendicular to a central longitudinal axis of the piston;

driving the gudgeon guide blocks toward one another along the gudgeon pin axis while the gudgeon core members are moving toward their engaged position;

driving the pair of outer panels and moving the outer panels is in a vertical directioninto a closed position in response to movement of the gudgeon core blocks wherein each of the outer panels is operably connected to respective gudgeon guide book;

molding fluid piston material within a mold cavity to form a piston body and about upper portions of the outer panels to form the undercut cooling gallery within the piston body;

moving the gudgeon core members away from one another to a disengaged position along the gudgeon pin axis;

driving the gudgeon guide blocks away from one another along the gudgeon pin axis in response to movement of the gudgeon core members toward their disengaged position;

driving the outer panels into an open position in response to movement of the gudgeon core blocks; and removing the piston body from the mold cavity.

21. The method of claim 20 further including sliding the outer panels along members in response to movement of the gudgeon guide blocks.

22. The method of claim 21 further including orienting the members to extend in oblique relation to the gudgeon pin axis.

23. The method of claim 20 further including moving the gudgeon core members relative to the gudgeon guide blocks during at least a portion of the movement of the gudgeon core members between their engaged and disengaged positions.

24. The method of claim 23 further including moving the gudgeon guide blocks conjointly with the gudgeon core members during at least a portion of the movement of the gudgeon core members between their engaged and disengaged positions.

25. The method of claim 20 further including moving the outer panels toward the closed position along a converging linear path that is oblique to the gudgeon pin axis.

26. The method of claim 25 further including moving the outer panels toward the open position along a diverging linear path that is oblique to the gudgeon pin axis.

* * * * *

UNITED STATES PATENT AND TRADEMARK OFFICE

CERTIFICATE OF CORRECTION

PATENT NO. : 8,459,332 B1
APPLICATION NO. : 13/544978
DATED : June 11, 2013
INVENTOR(S) : O'Connor et al.

It is certified that error appears in the above-identified patent and that said Letters Patent is hereby corrected as shown below:

In the Claims

| column | line | |
|---|---|---|
| 8 | 47 | "guide blocks the outer" should read "guide blocks wherein each of the outer" |

Signed and Sealed this
Sixth Day of August, 2013

Teresa Stanek Rea
*Acting Director of the United States Patent and Trademark Office*